United States Patent [19]

Petro

[11] 4,013,920

[45] Mar. 22, 1977

[54] SAFETY SWITCH WHICH RENDERS HID LAMP INOPERATIVE ON ACCIDENTAL BREAKAGE OF OUTER ENVELOPE

[75] Inventor: John Petro, Belleville, N.J.

[73] Assignee: Westinghouse Electric Corporation, Pittsburgh, Pa.

[22] Filed: Jan. 22, 1976

[21] Appl. No.: 651,306

[52] U.S. Cl. ..... 315/73; 315/74; 315/119; 315/106; 315/107; 313/17; 313/227

[51] Int. Cl.[2] ..... H01J 7/44; H01J 13/46; H01J 17/34; H01K 1/62

[58] Field of Search ..... 315/73, 74, 75, 47, 315/60, 119, 125, 106, 107; 313/17, 227

[56] References Cited

UNITED STATES PATENTS

| | | | |
|---|---|---|---|
| 2,113,314 | 4/1938 | Brueckmann | 315/47 |
| 2,286,789 | 6/1942 | Dench | 315/47 X |
| 2,950,417 | 8/1960 | Breeding et al. | 315/75 |
| 3,767,965 | 10/1973 | Collins et al. | 315/75 |
| 3,872,340 | 3/1975 | Collins | 315/75 |
| 3,965,387 | 6/1976 | Stuart et al. | 315/73 |

FOREIGN PATENTS OR APPLICATIONS

| | | | |
|---|---|---|---|
| 267,753 | 4/1970 | U.S.S.R. | 315/74 |

*Primary Examiner*—Saxfield Chatmon, Jr.
*Attorney, Agent, or Firm*—W. D. Palmer

[57] ABSTRACT

HID lamp has resilient safety switch positioned proximate the inner surface of the dome portion of the protective outer envelope in contact with an extremity of a resilient leaf-spring support portion of the arc tube frame, to maintain the switch in a closed position. When the envelope is shattered, the normally closed switch will open to break the electrical path to the arc tube, thereby rendering the lamp inoperative.

5 Claims, 6 Drawing Figures

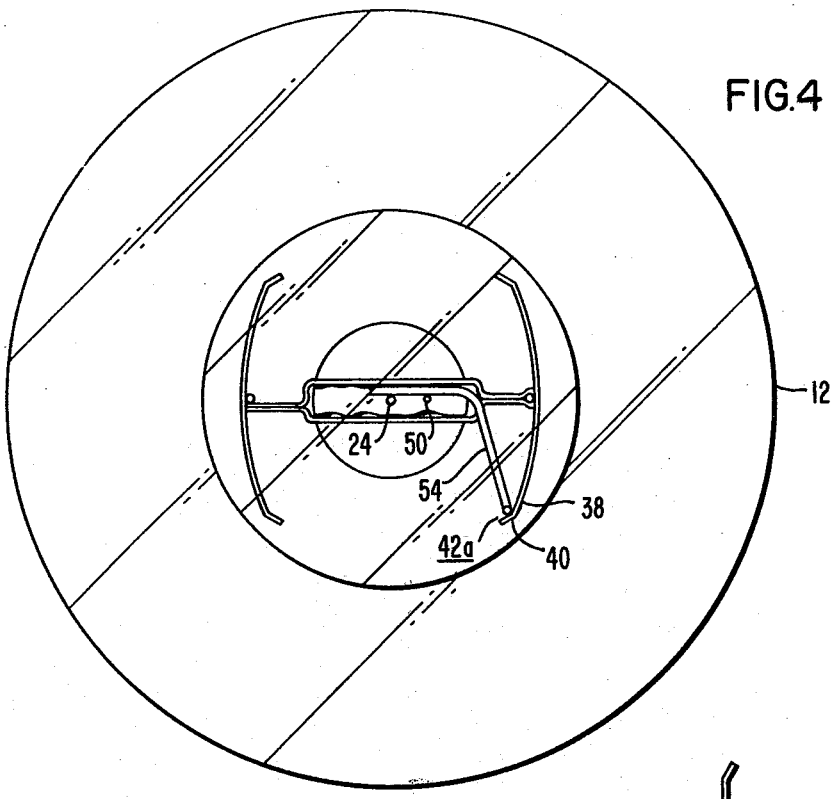
FIG.4
FIG.6
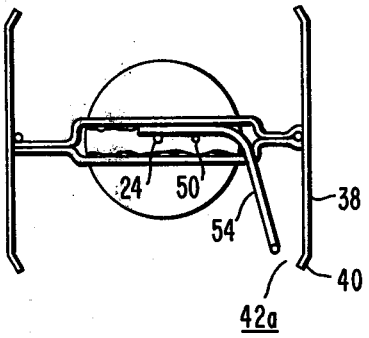
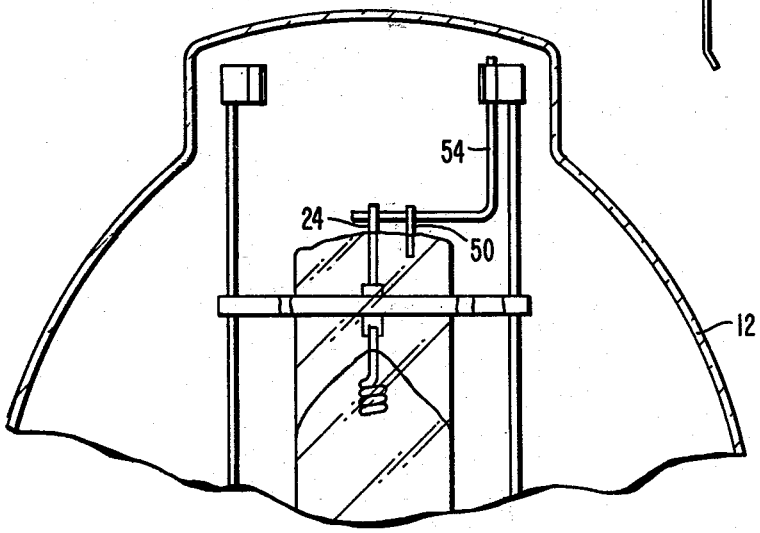
FIG.5

SAFETY SWITCH WHICH RENDERS HID LAMP INOPERATIVE ON ACCIDENTAL BREAKAGE OF OUTER ENVELOPE

CROSS-REFERENCE TO RELATED APPLICATION

In copending application Ser. No. 607,411, filed Aug. 25, 1975, and owned by the present assignee, is disclosed an HID lamp which has an oxidizable link positioned between the outer protective envelope and the arc tube and electrically connected in series with one of the lamp electrodes. Under normal lamp operating conditions, the link is heated to an incandescant condition and if the outer envelope is accidentally broken, the link immediately oxidizes and breaks to open the arc tube energizing circuit and render the lamp inoperative.

In copending Ser. No. 649,775, filed Jan. 16, 1976, which in turn is a continuation-in-part of copending application Ser. No. 609,138, filed Aug. 29, 1975, now abandoned, and owned by the present assignee, is disclosed an HID lamp which has a spring-loaded safety switch positioned between the outer protective envelope and the arc tube and electrically connected in series with one of the lamp electrodes. When the lamp is operating normally, the safety switch is maintained in the closed position, but if the outer envelope is accidentally broken, the switch automatically opens to break the lamp energizing circuit and render the lamp inoperative. The switch arrangement disclosed in the present application constitutes an improvement over those disclosed in the aforementioned copending applications.

BACKGROUND OF THE INVENTION

It has been reported that high-intensity discharge (HID) lamps, such as high-pressure, mercury-vapor lamps, can constitute a safety hazard if the outer envelope is broken and the lamp continues to operate, because of the generation of short wavelength ultraviolet radiations which are passed by the quartz arc tube. Lamps which are protected by a fuse are generally known in the art and a projection lamp which is fused in order to prevent dangerous arcing currents is described in U.S. Pat. No. 2,859,381 dated Nov. 4, 1958.

High-intensity discharge lamps have also been operated with a tungsten filament included between the arc tube and the outer envelope for purposes of ballasting the discharge and also generating some visible light. While the purpose of the ballasting and light-generating filament is not that of a link or safety switch, such a filament will normally oxidize and fail, particularly under lamp start-up conditions, if the outer envelope is broken, since this permits the filament to come in contact with air. Of course, such a supplemental ballasting filament consumes an appreciable portion of the total power consumed by the lamp, which decreases the lamp operating efficiency.

SUMMARY OF THE INVENTION

The basic HID lamp comprises an elongated radiation-transmitting arc tube which is longitudinally disposed and supported within an elongated light-transmitting protective envelope having a neck portion and a dome portion and which is opaque to short wavelength ultraviolet radiations. The arc tube encloses a conventional discharge-sustaining filling and electrodes are operatively positioned therein proximate the ends thereof. Electrical lead-in means are sealed through the arc tube and electrically connect to the electrodes. An electrical adaptor means, such as a screw type base, is affixed to the neck portion of the envelope to facilitate electrical connection of the lamp to a source of electrical power and electrical conductor means electrically connect the base to the arc tube lead-ins. The electrical conductor means includes a conventional arc tube supporting frame comprising rigid metallic supporting members longitudinally disposed within the protective envelope and having extremity portions proximate the dome portion of the protective envelope, and flexible leaf-spring members are affixed proximate the extremity portions of the supporting frame rigid metallic members and laterally extend therefrom, with the extremity portions of the leaf-spring members urged by their resiliency toward the inner surface of the dome portion of the protective envelope, to provide a lateral and somewhat resilient support for the arc tube. The foregoing lamp construction is generally conventional.

In accordance with the present invention, there is provided a switch means having a normal closed position in which it is electrically conducting and an open position in which it is electrically non-conducting. The switch means is included in series circuit arrangement intermediate the arc tube supporting frame and one of the arc tube electrical lead-in means. The switch means has a mechanically actuated contact member comprising a resilient elongated member having one end affixed to one of the arc tube lead-ins and the other end thereof is movable and urged by its resiliency toward the inner surface of the dome portion of the protective envelope and into electrical contact with one of the arc tube frame leaf-spring metallic members, to maintain the switch means in the closed position. Breakage of the protective envelope permits the resilient elongated body and the normally contacted leaf-spring support to be moved by their resiliencies out of electrical contact with each other thereby rendering the lamp inoperative.

BRIEF DESCRIPTION OF THE DRAWINGS

For a better understanding of the invention, reference may be had to the preferred embodiment, exemplary of the invention, shown in the accompanying drawings, in which:

FIG. 4 is an enlarged plan view, generally corresponding to FIG. 2, but showing a simplified alternative switch;

FIG. 5 is an enlarged fragmentary elevational view, shown partly in section, further illustrating the alternative embodiment as shown in FIG. 4; and FIG. 6 is an enlarged plan view, generally corresponding to FIG. 4, but showing the switch in the open position.

DESCRIPTION OF THE PREFERRED EMBODIMENT

Figure 1:
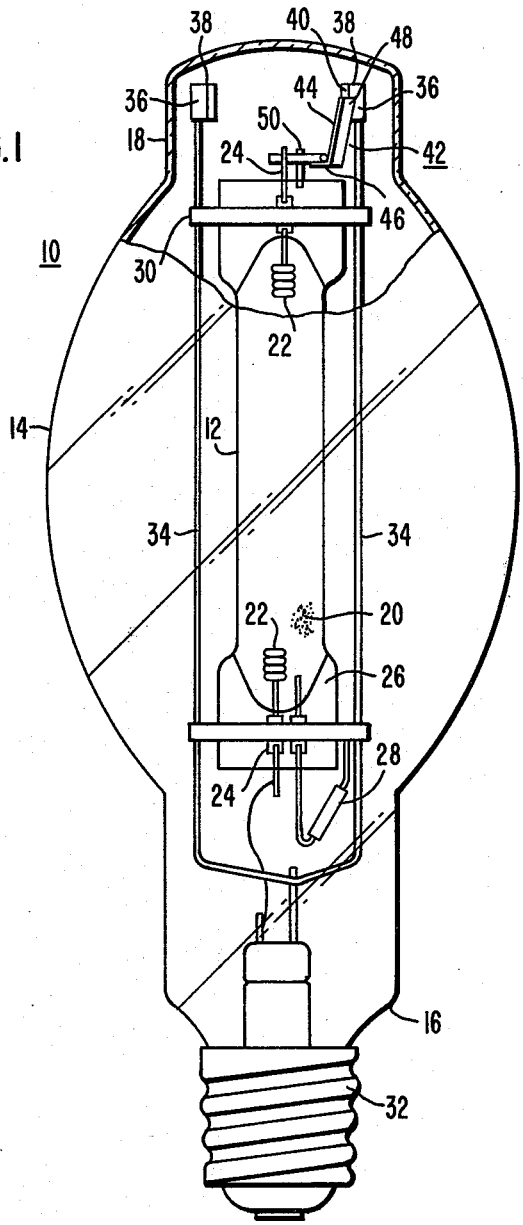
FIG. 1 is an elevational view, partly broken away, showing a high-intensity discharge lamp which incorporates an improved built-in safety switch, in accordance with the present invention.

In FIG. 1 is shown a high-intensity discharge lamp which in this embodiment is a high-pressure, mercury-vapor discharge lamp 10. The lamp comprises an elongated radiation-transmitting quartz arc tube 12 which is longitudinally disposed and supported within an elongated light-transmitting protective envelope 14 having a neck portion 16 and a dome portion 18. The envelope 14 is formed of glass, such as borosilicate glass, which is transmissive for visible radiations and opaque with respect to the short wavelength ultraviolet radiations which are generated within and transmitted through the arc tube 12. In accordance with conventional practices, the arc tube encloses a discharge-sustaining filling such as a small charge of mercury 20 and a small charge of inert starting gas such as 4 torrs of argon. The arc tube has electrodes 22 operatively positioned therein proximate the ends thereof and electrical lead-in means 24 includng a ribbon conductor and contact support are sealed through the arc tube and connect to the electrodes. A starting electrode 26 is positioned at one end of the arc tube and sealed therethrough and the starting electrode 26 connects through a starting resistor 28 to the arc tube supporting frame 30.

Electrical adaptor means 32, such as a conventional screw type base, is affixed to the neck portion 16 of the outer envelope in order to facilitate electrical connection of the lamp to the source of electrical power and an electrical conductor means electrically connects the base 32 to the lead-in conductors 24. The electrical means includes the arc tube supporting frame 30 which comprises rigid metallic supporting members 34 longitudinally disposed within the protective envelope 14 and having extremity portions 36 proximate the dome portion 18 of the protective envelope. Flexible leaf-spring metallic members 38 are affixed proximate the extremity portions 36 of the rigid supporting members 34 and laterally extend therefrom with the extremity portions 40 of the leaf-spring metallic members urged toward the inner surface of the dome portion 18 of the protective envelope by the resiliency of these springs, in order to provide a lateral and somewhat resilient support for the arc tube. The lamp and arc tube supports as described hereinbefore are generally conventional.

In accordance with the present invention, there is provided a switch means 42 having a normal closed position in which it is electrically conducting and an open position in which it is electrically non-conducting. The switch means 42 is included in series circuit arrangement intermediate the arc tube supporting frame 30 and one of the electrical lead-in means 24. The switch 42 has a mechanically actuated contact member comprising a leaf-spring body 44 having one end thereof 46 affixed to one of the electrical lead-ins 24 and the other end 48 being movable and urged by its resiliency toward the inner surface of the dome portion 18 of the outer protective envelope and in electrical contact with an extremity 40 of one of the leaf-spring members 38, in order to maintain the switch 42 in its closed, electrically conducting position. Breakage of the protective envelope 14 will permit the leaf-spring body 44 to be moved by its resiliency out of electrical contact with the extremity 40 of the leaf-spring metallic member 38 which it normally contacts, thereby breaking the circuit to the lamp lead-in conductor 24 and rendering the lamp inoperative.

Figure 2:
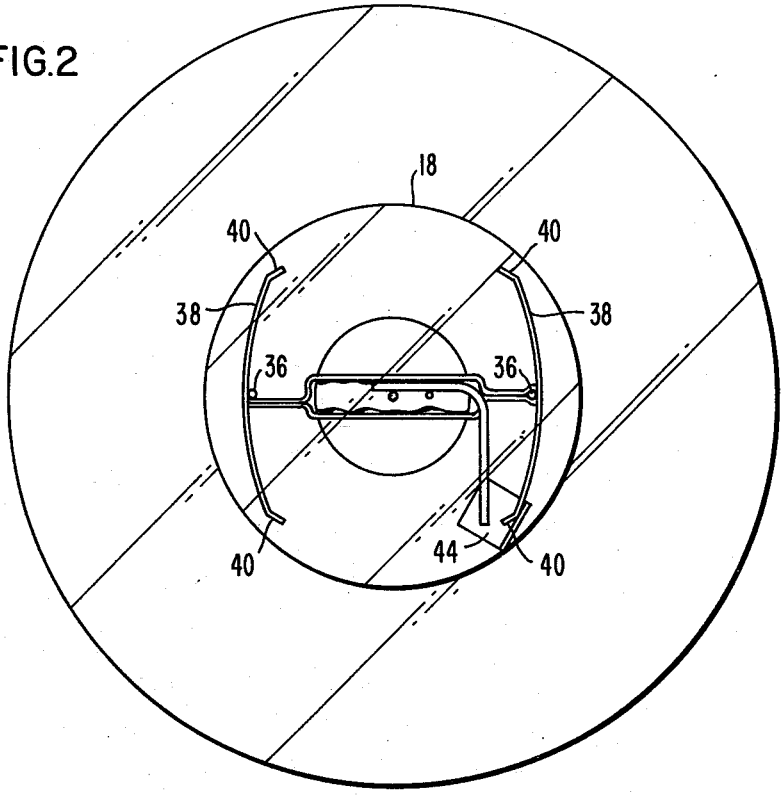
FIG. 2 is an enlarged plan view, showing details of the safety switch in its closed position.
Figure 3:
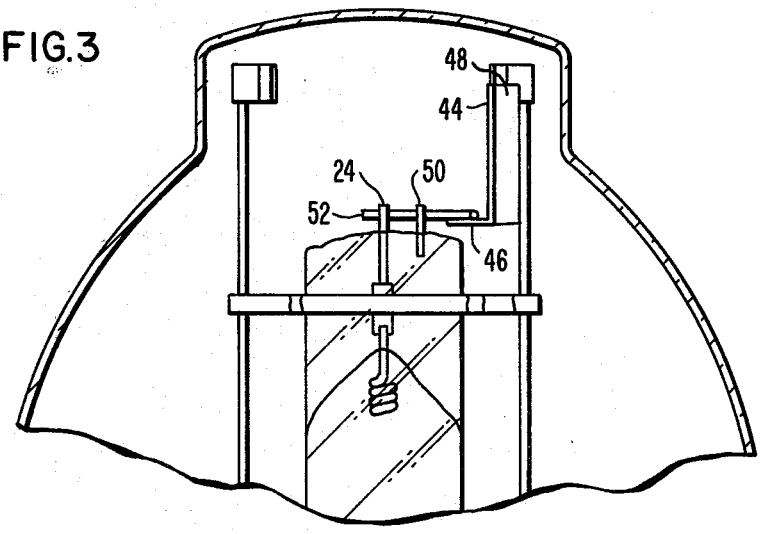
FIG. 3 is an enlarged fragmentary elevational view, shown partly in section, showing further construction details for the improved safety switch.

The switch construction of FIG. 1 is shown in greater detail in FIGS. 2 and 3 wherein the leaf-spring body 44 of the switch 42 contacts the inner surface of the protective envelope and is positioned intermediate such inner surface and an extremity portion 40 of the leaf-spring metallic member 38 which it normally contacts.

As shown in greater detail in FIGS. 2 and 3, an additional support member 50 projects from an end of the arc tube 12 and a wire-shaped support member 52 is affixed, such as by welding, both to the additional support member 50 and the electrical lead-in 24, in order to provide for a very positive connection. The fixed end 46 of the leaf-spring body 44 is affixed to the support member 52. All of the leaf-spring contact members as used in the foregoing construction preferably are fabricated of heat resistant alloy, such as nickel alloy.

The advantages of the present construction primarily reside in simplicity and cost since all of the lamp components are generally conventional except that the leaf-spring switch 42 is affixed to one of the lead-in means 24 to replace a conducting strip which normally connects the upper lead-in means 24 to the supporting frame 30. The foregoing switch is also very positive in performance since any breakage of the envelope will cause the entire envelope to shatter, thereby causing the switch 42 to move from a closed, conducting position to an open, non-conducting position.

In the form as shown, the movable end 48 of the leaf spring body 44 contacts the inner surface of the dome 18. If desired, the movable end 48 of leaf spring body 44 could rest against the extremity portion 40 of member 38.

An alternative switch construction **42*a* is shown in FIGS. 4 and 5, wherein a contact member 54, which is welded to the lead-in 24 and support 50, is formed of a nickel-iron wire, which has the form of a somewhat resilient, elongated body. As shown in FIG. 4, the wire 54 is bent near its connection with the arc tube 12 to be aligned with the extremity portion 40 of the leaf-spring support member 38, and as shown more clearly in FIG. 5, the wire 54 is further bent so that it will normally contact the inner surface of the extremity 40 of leaf-spring support 38. In this normal position, the resiliencies of both the wire 54 and the spring support 38 force the extremities of these members together proximate the inner surface of the dome portion 18 of the envelope 12, to complete the electrical circuit for the lamp. As in the previous embodiments, breakage of the envelope 12 permits the resilient body 54 and the spring support member 38 which it normally contacts to be moved by their respective resiliencies out of electrical contact with each other, thereby to render the lamp 10** inoperative.

The lamp with the outer envelope broken is shown in FIG. 6. Upon breakage of the envelope 12, the resiliency of the leaf-spring support 38 has moved the end portion thereof from contact with the contact member 54, thereby to place the switch **42*a*** in the open position to render the lamp inoperative.

While a high-pressure mercury-vapor lamp has been illustrated and described, other types of HID lamps can utilize the present improved safety switch, examples being mercury-metal halide HID lamps and high pressure sodium HID lamps.

I claim:

1. In combination with a high-intensity discharge lamp comprising an elongated radiation-transmitting arc tube which is longitudinally disposed and supported within an elongated light-transmitting protective envelope having a neck portion and a dome portion and which is opaque to short wavelength ultraviolet radiations, said arc tube enclosing a discharge-sustaining filling and having electrodes operatively positioned therein proximate the ends thereof, electrical lead-in means sealed through said arc tube and connected to said electrodes, electrical adaptor means affixed to the neck portion of said envelope to facilitate electrical connection of said lamp to a source of electrical power, electrical conductor means electrically connecting said electrical adaptor means to said electrical lead-in means, said electrical conductor means including an arc tube supporting frame comprising elongated rigid metallic supporting members longitudinally disposed within said protective envelope and having extremity portions proximate the dome portion of said protective envelope, and flexible leaf-spring metallic members affixed proximate the extremity portions of said rigid metallic supporting members and laterally extending therefrom with the extremity portions of said leaf-spring members urged toward the inner surface of said dome portion of said protective envelope by the resiliency of said leaf-spring members to provide a lateral and somewhat resilient support for said arc tube, the improvement which comprises:

switch means having a normal closed position in which said switch means is electrically conducting and an open position in which said switch means is electrically non-conducting, said switch means included in series circuit arrangement intermediate said arc tube supporting frame and one of said electrical lead-in means, said switch means including a mechanically actuated contact member comprising a resilient elongated body having one end affixed to said one of said electrical lead-in means, and the other end of said resilient elongated body being movable and urged by its resiliency toward the inner surface of said dome portion of said protective envelope and in electrical contact with one of said leaf-spring metallic members to maintain said switch means in said closed position, and breakage of said protective envelope permitting said resilient elongated body and said leaf-spring support member which normally contacts said resilient elongated body to be moved by their resiliencies out of electrical contact with each other, thereby to render said lamp inoperative.

2. The lamp as specified in claim 1, wherein said lamp is a high-pressure mercury-vapor lamp.

3. The lamp as specified in claim 2, wherein said resilient elongated body of said switch means has its movable end contacting the inner surface of an extremity portion of said one leaf-spring metallic member.

4. The lamp as specified in claim 2, wherein said resilient elongated body has the configuration of a somewhat flexible wire.

5. The lamp as specified in claim 2, wherein said resilient elongated body has a portion formed as a leaf-spring movable at one end and urged by its resiliency toward the dome portion of said envelope to contact said one leaf-spring metallic member to maintain said switch means in said closed position.

* * * * *